United States Patent [19]

Oberhardt

[11] 4,309,189

[45] Jan. 5, 1982

[54] METHOD AND MEANS FOR PRODUCING SUSTAINED COLORED FLAMES

[76] Inventor: Bruce J. Oberhardt, 405-4 Bercado Cir., Mishawaka, Ind. 46544

[21] Appl. No.: 174,006

[22] Filed: Jul. 31, 1980

[51] Int. Cl.[3] ..... C10L 9/08; C10L 10/00

[52] U.S. Cl. ..... 44/4

[58] Field of Search ..... 44/1 R, 6, 7.5, 40, 44/38, 4

[56] References Cited

U.S. PATENT DOCUMENTS

| | | | |
|---|---|---|---|
| 1,617,996 | 2/1927 | Ellis | 44/6 |
| 1,705,020 | 3/1929 | Kohr | 44/6 |
| 2,398,571 | 4/1946 | Young | 44/1 R |
| 3,107,511 | 10/1963 | Hamsag et al. | 44/7.5 X |
| 3,150,510 | 9/1964 | Klopfenstein | 44/7.5 X |
| 3,370,932 | 2/1968 | Kelly et al. | 44/40 X |
| 4,042,313 | 8/1977 | Pierce | 44/6 X |
| 4,202,669 | 5/1980 | Ball | 44/40 |

*Primary Examiner*—Carl F. Dees

*Attorney, Agent, or Firm*—Oltsch, Knoblock & Hall

[57] ABSTRACT

A chemical compound and the method for using it to produce and prolong colored flames. The compound contains a metallic salt and a matrix. The metallic salt produces the color and the matrix prolongs the life of that color.

3 Claims, 2 Drawing Figures

METHOD AND MEANS FOR PRODUCING SUSTAINED COLORED FLAMES

SUMMARY OF THE INVENTION

This invention relates to a method for producing prolonged coloration of the flames in a fire, and to a flame coloration compound used in said method.

Prior attempts to enhance colored flame production have produced only short-lived results. The color production often was not great as well as lasting only a short time. Previous compounds have, generally, been one of four types. The first type includes powders which are sprinkled, poured or placed upon logs in a fire. These powders have usually been metallic salts. The second type is cakes or pellets formed of a combination of metallic salts and paraffin. These cakes increase the intensity of the yellow flame due to the combustion of paraffin, but the length of the burn and the colored flame propogation is short. Pre-treating of logs is a third type of treatment to produce colored flame. Logs are soaked either overnight or for several days in a metallic salt solution. The soaked log, when dry, will burn and produce long-lasting, brilliant colors, provided sufficient chemicals have been used in the treatment. This method is very time consuming and inconvenient. Finally, synthetic logs have been treated with color producing material. The synthetic logs are used primarily for fuel and burning thereof lacks the color brilliance of the aforementioned, pre-treated logs. Synthetic logs are produced from a composition of sawdust, wood chips and paraffin. Some metallic salts may be used in synthetic logs. This is usually done to tone down the intense yellow color resulting from the combustion of paraffin.

The present invention consists of the use of an optimized mixture of two constituents, (1) a specific chemical or mixture of chemicals in solid or powdered form which produces flames of desired color when placed in an open fire, usually a metallic salt; and (2) a non-combustible or slow-burning non-volatile second substance or matrix material or mixture thereof. The color producing chemical is either absorbed into the matrix before being placed into the fire or becomes absorbed with the matrix upon an interaction occurring within the fire. The compound contains no oxidizing agent and thus is unable to sustain a flame by itself.

The matrix material, e.g. boric acid, etc., serves several purposes. The matrix prolongs flame color by physically and/or chemically holding or entrapping the color compound. The relatively low volatility of the matrix provides adherence of matrix on burning wood and logs, and this, in turn, keeps the color compound in flame contact for a substantial period of time. In the absence of the matrix, the effect of the color compound would be rapidly lost incident to vaporization of the compound or to its falling from the flames.

The addition of a second metallic salt has been used to increase color propogation produced by another metallic salt. However, the use of boric acid or barium chloride as a matrix to enhance the life of the color of flames has not been known heretofore.

Accordingly, it is an object of this invention to provide a novel material for producing prolonged colored flames in a fire.

Another object of this invention is to provide a novel method of prolonging desired flame coloration in a fire.

Other objects will become obvious upon a reading of the following description.

DESCRIPTION OF THE PREFERRED EMBODIMENTS

The preferred embodiments illustrated and described are not intended to be exhaustive or to limit the invention to the precise form disclosed. They are chosen and described in order to best explain the principles of the invention and its application and practical use to thereby enable others skilled in the art to best utilize the invention.

Figure 1:
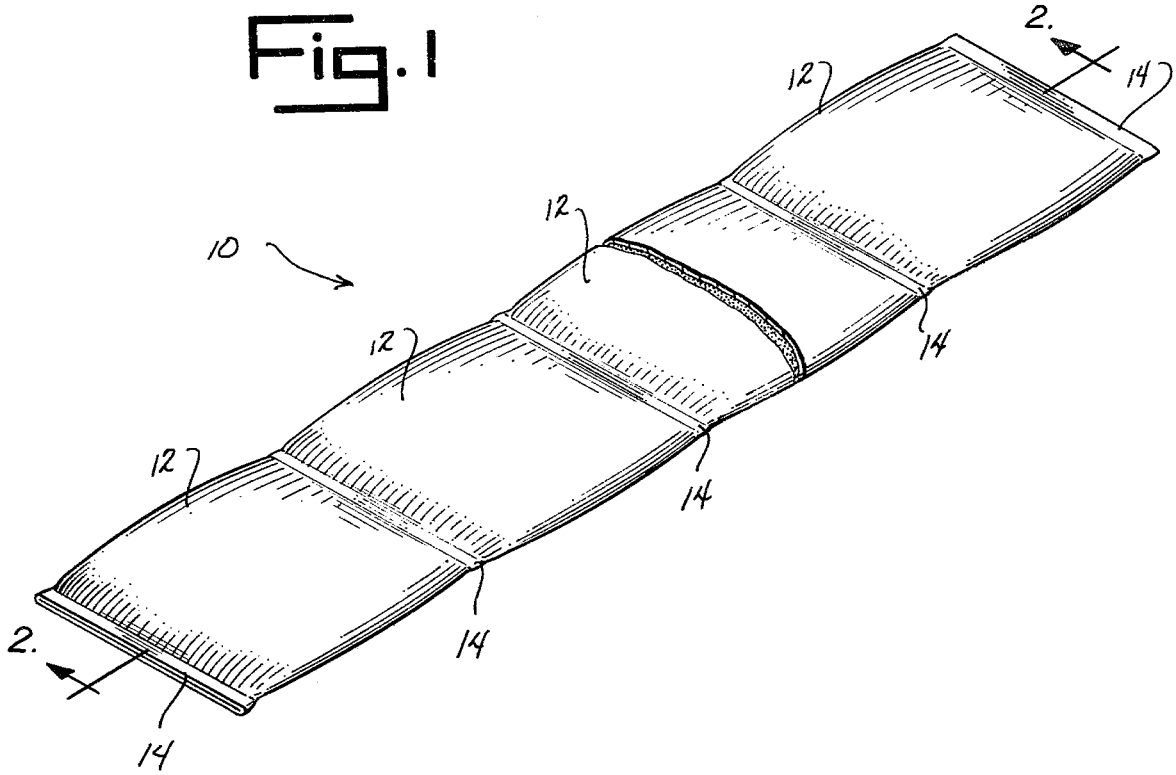
FIG. 1 is a perspective view of one form of package of the color producing chemical.
Figure 2:
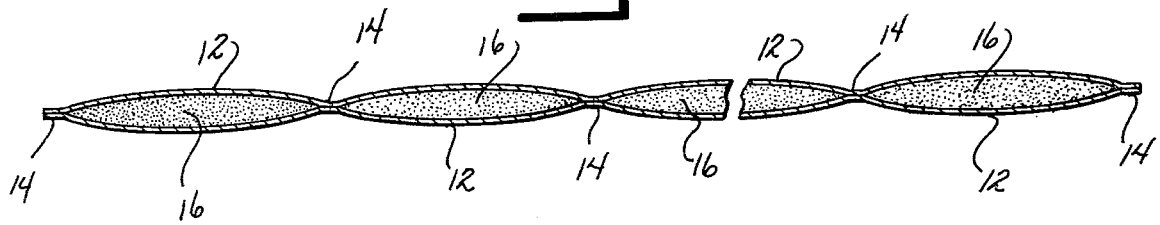
FIG. 2 is a cross sectional view taken on line 2—2 of FIG. 1.

The compound of this invention is used to increase flame color in a fire, thereby creating a more aesthetic and colorful effect and increasing the observer's enjoyment of a fire. The compound may be used in powdered form packaged in a combustible container or shaped into a solid form by use of a binder. As shown in FIG. 1, the container 10 consists of a series of individual packets 12, each separately sealed by seal lines 14 and each containing a selected quantity of powdered color producing material. FIG. 2 depicts the separation of individual packets 12 created by sealing along seal lines 14. Color compound 16 is evenly distributed throughout each packet 12. In use, a container 10 of selected size containing a selected number of packets 12 is laid atop a log for burning. Each packet 12 may contain the same or differing compounds 16. The separation of individual packets 12 by seal lines 14 assures even distribution of compound 16 or compounds along the length or surface of the firewood or log.

The compound can also be formed into solid shapes with the addition of a binding agent. The use of a binding agent allows for the production of sheets, slabs and cakes which are more readily adaptable to a gas fire. Binding agents used are of three kinds: (1) high molecular weight polyglycols, such as mono-methoxypolyethylene glycol of a molecular weight approaching 6,000, (2) paraffin and (3) acacia gums, (i.e., gum arabic).

The color compound is a mixture of a metallic salt, such as copper chloride or copper sulfate, and a matrix material or mixture thereof, such as boric acid and charcoal. The metallic salts can be used either separately or in a mixture to produce any of a multiplicity of colors. The color producing substances which may be utilized include copper compounds, e.g. copper sulfate and copper chloride, which produce flame coloration, as well as potassium halides, sodium halides, lithium sulfate, strontium chloride, barium chloride, a combination of copper sulfate and ammonium chloride, and a combination of copper chloride and ammonium chloride. The matrices which may be used include boric acid, boric acid forming matrices, barium chloride, sucrose or carbon forming matrices, or carbon, e.g. powdered wood charcoal, magnesium chloride, lithium sulfate and aluminum sulfate. Barium chloride is a matrix substance when mixed with certain color producing substances, and when mixed with other matrix substances it may be a color producing substance. The same is true for lithium sulfate. As may be found in the pyrotechnic literature, ingredients which could be utilized for color producing substances include the metallic salts listed, as well as salts for barium and calcium. However, not all such metallic salts are suitable for use with the same matrix, and not all are advantageous for use in a wood fueled fire. A detailed description of the interaction of matrices and color producing substances is set out in Table One. All of the tests performed which are recorded in Table One have been carried out with wood fires. As shown with the asterisk (*) under the column for the final three matrices (magnesium chloride, lithium sulfate, aluminum sulfate) a propane flame, as found in gas fireplaces, as opposed to wood fireplaces, does produce excellent quality with the aforementioned matrices.

EXAMPLES

EXAMPLE 1

A mixture of 50 percent, by weight, ammonium chloride and 50 percent, by weight, copper sulfate (both constituents in powdered form) was prepared and labelled Component A. To one part Component A, two parts, by weight, of boric acid (labelled Component B) was added. The resulting mixture was compared with Component A alone and Component B alone in a flame. For this experiment, a propane torch was utilized to provide the flame. Each test batch was weighed out into a 30 mg. portion and poured onto an iron spatula. Each iron spatula was held in the flame for ten minutes, and progress of color development was observed. For Component A alone, blue and green flames resulted with many in-between hues, combinations and variations. The color began as an intense blue, became greener and ceased to produce color after 45 seconds. Component B, alone, produced a green color of less intensity than Component A, the color fading to an imperceptible level in about 30 seconds. With the mixture of A and B, as described, colors similar to those obtained by A alone were produced. However, the flame coloration was observed for the duration of the experiment. At ten minutes when the experiment was terminated, a moderate level of green color persisted.

EXAMPLE 2

The experiment performed in Example 1 was performed with copper sulfate as Component A and boric acid as B. In this case, one part, by weight, of Component A was added to one part, by weight, of Component B. Component A produced a bright green flame for about 40 seconds. Component B provides dull green flames for about 30 seconds. The mixture of A and B, as in Example 1, was still producing green flame coloration after ten minutes.

EXAMPLE 3

A quantity of mixture consisting of 50 percent powdered boric acid, 25 percent powdered copper chloride and 25 percent powdered ammonium chloride was weighed out to 14 g. This mixture was placed in an average size fire fueled with natural wood logs. Flame colors (greens, blues, yellow greens) appeared after a few minutes in some areas of the fire. The flame colors reached a peak intensity after about 25 minutes and persisted for more than an hour.

EXAMPLE 4

Strontium chloride was applied to a flame, as in Example 1, and crimson colors were observed. After about 10 seconds the color ceased. Magnesium chloride was similarly applied to a flame and no color propogation was observed, except for the original propane color. A mixture of 50 percent strontium chloride and 50 percent magnesium chloride, both in granular form, was introduced to the flame. A 30 mg. sample of this mixture produced intense crimson flames for more than 10 minutes.

EXAMPLE 5

A mixture of 10 mg. powdered magnesium chloride, 10 mg. ammonium chloride, 10 mg. copper sulfate and 10 mg. lithium sulfate was held in a propane torch flame on an iron spatula and colors of blue, green, and intense magenta were observed.

It is noted that one compound has been found that is capable of acting as both color producing agent and matrix. The compound is copper borate ($Cu(BO_2)_2$). Copper borate is produced by the interaction of copper hydroxide and boric acid. Therefore, when using copper borate in a fire, i.e., a color producing copper compound (copper hydroxide) and a matrix are interacted prior to application to a fire, the result of use of the copper borate is the same as the result of applying to a fire separately the aforementioned components thereof.

It is understood that the invention is not to be limited by the preceding description but may be practiced within the scope of the appended claims.

TABLE ONE

| COLOR PRODUCING AGENT | BORIC ACID | BARIUM CHLORIDE | SUCROSE | POWDERED CHARCOAL | MAGNESIUM CHLORIDE | LITHIUM SULFATE | ALUMINUM SULFATE | |
|---|---|---|---|---|---|---|---|---|
| $Cu_2SO_4$ | Greens | Green/ Yellow-Green | Green | Bright Green | — | — | — | Color |
| | Excel. | Excel. | Fair/ Good | Fair/ Good | | | | Quality |
| KCl | Blue-Purple/ Green | — | Blue-Purple | Dull Blue-Purple | Dull Blue-Purple | Dull Blue/Red Purple | Dull Blue-Purple | Color |
| | Good | | Good | Good | Fair-Poor* | Fair-Poor* | Fair-Poor* | Quality |
| NaCl | Yellow Green | | Yellow | Yellow | | | | |
| | Good | | Good | Good | | | | |
| $Cu_2SO_4$ + $NH_4Cl$ | Blue/ Green | Blue & Yellow-Green | Blue/ Green | Blue/ Green | | | | Color |
| | Excel. | Excel. | Fair/ Good | Fair/ Good | | | | Quality |
| $Cucl_2$ | | Blue & | | | | | | |

TABLE ONE-continued

| COLOR PRODUCING AGENT | BORIC ACID | BARIUM CHLORIDE | SUCROSE | POWDERED CHARCOAL | MAGNESIUM CHLORIDE | LITHIUM SULFATE | ALUMINUM SULFATE | |
|---|---|---|---|---|---|---|---|---|
| + $NH_4Cl$ | Blue/ Green | Yellow-Green | Blue/ Green Fair/ Good | Blue/ Green Fair/ Good | | | | |
| $CuCl_2$ | Excel. Green | Excel. Green/ Yellow-Green | Green Fair/ Good | Green Fair/ Good | | | | |
| $Li_2SO_4$ | Excel. | Excel. Green to Magenta Fair | | | Magenta Fair-Poor* | | Magenta Fair-Poor* | |
| $SrCl_2$ | | | | | Crimson Fair-Poor* | Crimson & Magenta Fair-Poor* | Crimson Fair-Poor* | Color Quality |
| BaCl | | | | | Yellow-Green Fair-Poor* | | Yellow-Green Fair-Poor* | Color Quality |

What I claim is:

1. A flame colorant consisting of a mixture of a color producing agent and a matrix, said color producing agent including at least one metallic compound, said matrix being a substantially low-volatile, non-combustible substance capable of prolonging the duration of flame coloration over that achieved by either of said agent or said matrix alone, and said matrix is a material of low volatility selected from a group of the class consisting essentially of boric acid or a source thereof, barium chloride, magnesium chloride, lithium sulfate and aluminum sulfate.

2. The method of producing sustained colored flames of a fire consisting of applying to a flame a mixture consisting of at least one color producing metallic compound and at least one matrix, said matrix consisting of a substantially non-combustible substance, wherein said metallic compound and said matrix are mixed and interact prior to application thereof to produce a mixture capable of prolonging the duration of flame coloration over that achieved by either said metallic compound or said matrix used along, said matrix being a material which consists of at least one of the following: boric acid or a source thereof, barium chloride, magnesium chloride, lithium sulfate, and aluminum sulfate.

3. The method of producing sustained colored flames of a fire consisting of applying to a flame a mixture consisting of at least one color producing metallic compound and at least one matrix, said matrix consisting of a substantially non-combustible substance, wherein said metallic compound and said matrix are mixed and interact prior to application thereof to produce a mixture capable of prolonging the duration of flame coloration over that achieved by either said metallic compound or said matrix used alone, said metallic compound being copper hydroxide and said matrix being boric acid which have interacted to form copper borate.

* * * * *